US006179689B1

(12) United States Patent
Ohno et al.

(10) Patent No.: US 6,179,689 B1
(45) Date of Patent: Jan. 30, 2001

(54) SPHERICAL MIRROR SURFACE PROCESSING METHOD AND DEVICE

(75) Inventors: Kenichi Ohno; Masashige Mitsuhashi, both of Tokyo (JP)

(73) Assignee: NEC Corporation, Tokyo (JP)

( * ) Notice: Under 35 U.S.C. 154(b), the term of this patent shall be extended for 0 days.

(21) Appl. No.: 09/082,055

(22) Filed: May 21, 1998

(30) Foreign Application Priority Data

May 30, 1997 (JP) ..... 9-141694

(51) Int. Cl.[7] ..... B24B 1/00

(52) U.S. Cl. ..... 451/41; 451/59; 451/299; 451/42; 451/57; 451/305

(58) Field of Search ..... 451/41, 42, 59, 451/57, 299, 60, 305–307

(56) References Cited

U.S. PATENT DOCUMENTS

| | | | | |
|---|---|---|---|---|
| 5,048,238 | * | 9/1991 | Ikeda | 451/60 |
| 5,136,820 | | 8/1992 | Luther . | |
| 5,722,877 | * | 3/1998 | Meyer et al. | 451/59 |
| 5,727,989 | * | 3/1998 | Ohno et al. | 451/59 |
| 5,916,012 | * | 6/1999 | Pant et al. | 451/296 |
| 5,951,374 | * | 9/1999 | Kato et al. | 451/58 |
| 5,967,881 | * | 10/1999 | Tucker | 451/60 |

FOREIGN PATENT DOCUMENTS

| | | |
|---|---|---|
| 34 29 235 C2 | 5/1987 | (DE) . |
| 37 34 741 A1 | 9/1987 | (DE) . |
| 44 12 010 A1 | 10/1994 | (DE) . |
| 196 29 528 A1 | 1/1997 | (DE) . |
| 1-264759 | 10/1989 | (JP) . |
| 5-157941 | 6/1993 | (JP) . |

* cited by examiner

*Primary Examiner*—David A. Scherbel
*Assistant Examiner*—Lee Wilson
(74) *Attorney, Agent, or Firm*—Sughrue, Mion, Zinn, Macpeak & Seas, PLLC

(57) ABSTRACT

The device of this invention is made up by: a stage having an upper surface for which a section taken at a right angle to the longitudinal direction describes a concave arc; abrasive tape arranged on the stage at a right angle to the longitudinal direction; a mechanism for driving the abrasive tape; a mechanism that applies pressure and places the end face of the workpiece in contact with the abrasive tape such that the center of the radius of curvature of the section of the stage coincides with the center of rotation of a rod-like workpiece; a mechanism for giving the workpiece a reciprocating movement over the surface depression in the longitudinal direction of the stage while rotating the workpiece; arid a water-holding material that contains a grinding fluid that produces a thin and uniform film of grinding fluid on the surface of the abrasive tape.

11 Claims, 7 Drawing Sheets

SPHERICAL MIRROR SURFACE PROCESSING METHOD AND DEVICE

BACKGROUND OF THE INVENTION

1. Field of the Invention

The present invention relates to a method and device for processing into a convex spherical mirror form the end face of an optical fiber connector, a cylindrical material, or a block-shaped end face made of glass, ceramic, or plastic, and particularly to a method and device that can carry out processing with improved efficiency and accuracy.

2. Description of the Related Art

FIG. 1 is a schematic view showing the connection portion of the two end faces 8 of ferrule 21 of an optical connector 22 that has undergone a mirror grinding process to produce a convex spherical form. When two optical fibers 23 are connected and optical signals are propagated, every effort must be made to suppress the optical loss and reflection that occur at the gap between the end faces of the optical fibers. Currently, PC (Physical Contact) optical connectors 22 are widely employed as a method of realizing connections with low optical loss. In these PC optical connectors 22, end faces 8 of ferrules 21 provided at the ends of optical fibers 23 are formed with convex spherical mirror surfaces and the end faces of optical fibers 23 are brought into close contact.

When fabricating PC optical connector 22, surplus adhesive or surplus length of optical fiber may remain at the tip from the process of inserting and securing optical fiber 23 in ferrule 21. When mirror grinding end face 8 to a convex spherical form in a processing device of the prior art, this surplus adhesive or surplus optical fiber is first removed by coarse grinding, and then, as shown in FIG. 2, abrasive tape 2 is disposed over stage 3 having a surface for which the section is a concave arc, the end face of workpiece 1 is placed in contact with abrasive tape 2 and pressure applied, abrasive tape 2 is put in motion while confined to the upper surface of stage 3 in concave form, workpiece 1 is given a rotating and back-and-forth motion to transfer the concave surface shape of stage 3 to workpiece 1 by the grinding action of the abrasive tape and finish a smooth, convex spherical form (Refer to, for example, Japanese Patent Laid-open No. 029599/97).

The above-described ferrule end-surface spherical processing method of the prior art has the disadvantage of low processing efficiency because grinding fluid is not employed, and in cases in which grinding fluid is supplied as in normal grinding methods, there is the disadvantage that the amount of grinding fluid supplied becomes excessive, or that an appropriate amount of grinding fluid cannot be supplied in the processing of the spherical surface of the end face of the ferrule.

SUMMARY OF THE INVENTION

The object of the present invention is to solve the above-described problems of the prior art by providing a spherical processing device and processing method that can process, not only an optical fiber connector, but the end face of a block or cylindrical material made of, for example, glass or ceramic, into a mirror surface of convex spherical shape with high efficiency and high accuracy.

In the present invention, processing efficiency can be improved and a workpiece that has a highly accurate mirror surface can be obtained by running an abrasive tape over a stage that has an upper surface for which the section is a concave arc; pressing the end face of the workpiece into contact with the tape and rotating, and in addition, giving a reciprocating movement to the workpiece; and supplying a thin film of grinding fluid to the surface of the abrasive tape.

In addition, the vertical load applied to the workpiece is reduced during initial processing in which the edge portions of the end face are ground, and then increased upon completion of processing of the edge portions, whereby the movement of the abrasive tape does not become unstable and processing can be carried out with high efficiency.

Further, the exchange of abrasive tape is simplified by providing the abrasive tape in cassette form.

Finally, processing of the workpiece continues without interruption because the time of reversal of the rotation of the workpiece does not coincide with the time of reversal of the reciprocating movement, thereby both improving processing efficiency and realizing stable processing without sudden loads being placed on the workpiece.

According to first spherical mirror surface processing method of the present invention, in a spherical processing method that processes the end face of the workpiece by means of the grinding action of an abrasive tape, wherein the abrasive tape is arranged on a stage having an upper surface For which a section taken at a right angle to the longitudinal direction describes a concave arc, the end face of a workpiece is placed in contact with the abrasive tape and pressure is applied, the abrasive tape is put in motion, and the workpiece is given a rotating and reciprocating movement; an amount of 10 $cc/m^2$ to 50 $cc/m^2$ of grinding fluid is supplied to the surface of the abrasive tape to generate a thin and uniform layer of grinding fluid. The processing efficiency is thus improved by supplying a uniform and consistent amount of grinding fluid to the working surfaces of the abrasive tape.

According to the second spherical mirror surface processing method of the present invention, in the first spherical mirror surface processing method of the present invention described hereinabove, the processing pressure applied against the end face of the workpiece is reduced in initial processing in which the edge portions of the end face of the workpiece are processed, and the processing pressure is increased upon completion of processing of the edge portions. In other words, the processing load focuses on the edge portions during initial processing because the flat end face of the workpiece presents a pointed edge portion. A low processing load is therefore applied until processing of the edge portions is completed. In this way, the application of excessive load is avoided as necessary so that the edge portions do not cause instability in the movement of the abrasive tape, thereby ensuring stable initial processing. The processing pressure is then increased upon completion of processing of the edge portions to allow more efficient processing.

The first spherical mirror surface processing device of the present invention is provided with a water-holding material that contains a grinding fluid for generating a thin and uniform grinding fluid film on the surface of the abrasive tape in an end face processing device that includes: a stage having an upper surface for which a section taken at a right angle to the longitudinal direction describes a concave arc; an abrasive tape arranged on the stage perpendicular to the longitudinal direction; a mechanism for driving the abrasive tape; a mechanism for placing the end face of the workpiece in contact with the abrasive tape and applying pressure such that the axis of rotation of a rod-shaped workpiece coincides with the center of the radius of curvature of the section of the stage; and a mechanism for moving the rod-shaped workpiece back and forth on the concave surface of the stage in the longitudinal direction while rotating the rod-shaped workpiece. The water-holding material enables a uniform and consistent supply of the necessary amount of grinding fluid to the working surface of the abrasive tape, thereby enabling an improvement in processing efficiency. The water-holding material may employ, for example, fiber or sponge of porous substance made from, for example, polyurethane foam.

According to the second spherical mirror surface processing device of the present invention, in the first spherical mirror surface processing device of the present invention described above, a load varying device is provided that reduces the processing pressure for a certain fixed interval of time until the edge portion is processed during initial processing of the end face of the workpiece, and subsequently increases the processing pressure. In other words, during initial processing, the end face of a workpiece is flat and the edge portion is therefore pointed, with the result that the processing load focuses on the edge portion. A low processing load is therefore applied until processing of the edge portion is completed. In this way, the application of excessive load is avoided as necessary so that the edge portion does not cause instability in the movement of the abrasive tape, thereby enabling stable initial processing. The processing pressure is then increased upon completion of processing of the edge portion to allow more efficient processing.

According to the third spherical mirror surface processing device of the present invention, in the first spherical mirror surface processing device described above, a cassette abrasive tape device is provided that accommodates the abrasive tape and that comprises: an abrasive tape supply roller; an abrasive tape take-up roller; a leaf spring that applies resistance to the rotation of the supply roller; and a cassette that accommodates the supply roller and take-up roller, and moreover, that includes an opening for supplying grinding fluid to the abrasive tape by means of a water-holding material; the cassette abrasive tape device being provided so as to allow insertion into or ejection from a mechanism for driving the abrasive tape.

The use of this type of cassette abrasive tape device raises processing efficiency by simplifying the exchange of abrasive tapes in the processing device; and in addition, the resistance to the rotation of the supply roller applied by the leaf spring provides an easy source of tension to the abrasive tape to enable stable grinding work without resorting to complicated devices such as a torque motor in the supply roller as practiced in the prior art.

According to the fourth spherical mirror surface processing device of the present invention, in the first spherical mirror surface processing device described above, separate mechanisms are provided for rotating a rod-shaped material and for moving the rod-shaped material back and forth in the longitudinal direction on the concave upper surface of the stage, the direction of rotation of the rod-shaped material being reversed midway in the linear movement of the back-and-forth movement. In other words, a state is not created in the rotating and reciprocating movements OF the rod-shaped material in which processing stops instantaneously, i. e., a state in which both movements reverse simultaneously; and as a result, the rod-shaped material undergoes processing continuously and processing efficiency is improved. Stable processing is further allowed because the rod-shaped material is not subjected to abrupt loads.

The above and other objects, features, and advantages of the present invention will become apparent from the following description based on the accompanying drawings which illustrate an example of a preferred embodiment of the present invention.

DETAILED DESCRIPTION OF THE PREFERRED EMBODIMENTS

Figure 3:
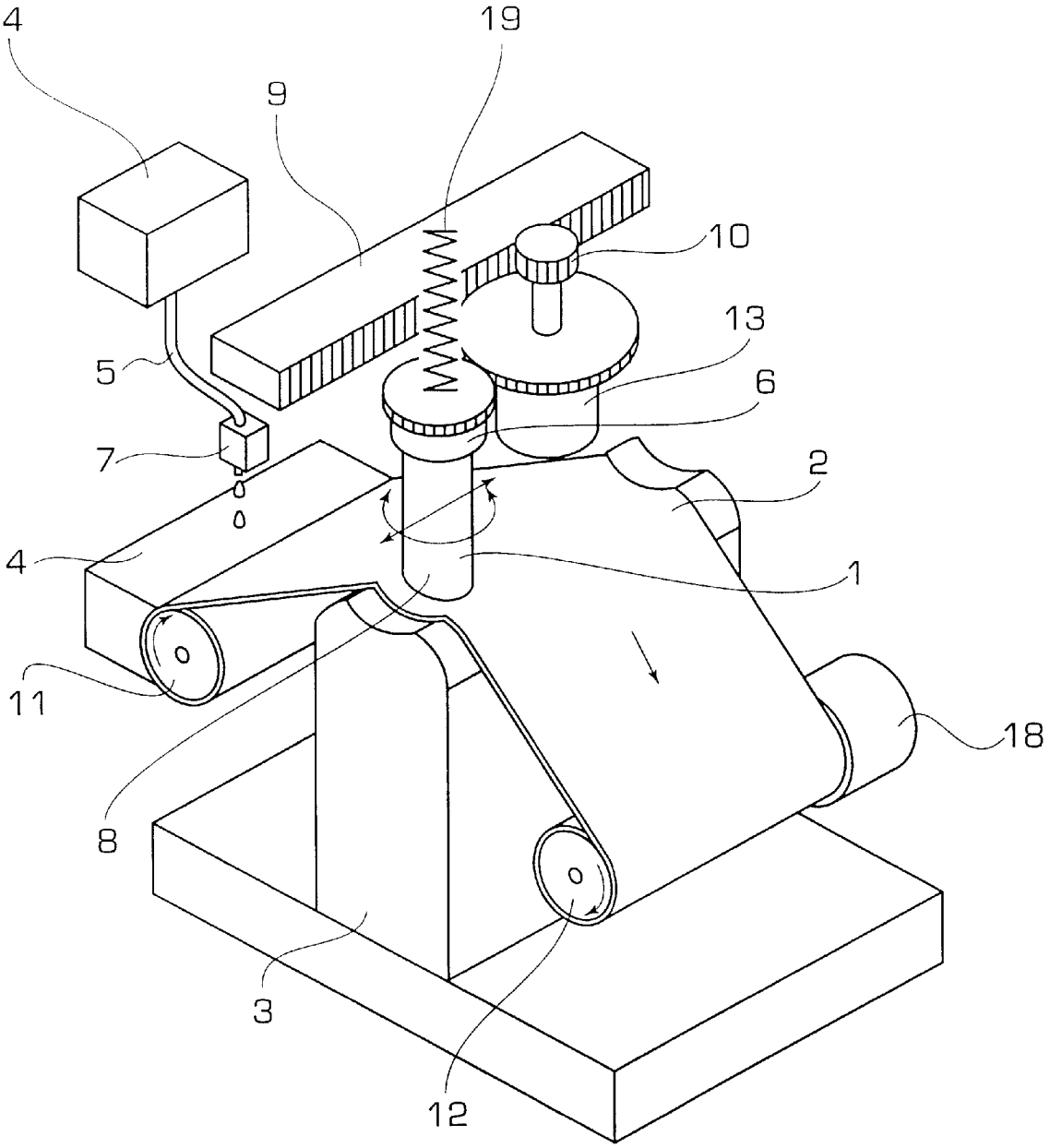
FIG. 3 is a schematic perspective view showing the first embodiment of a spherical mirror surface processing device of the present invention.

The embodiments of the present invention are described hereinbelow with reference to the accompanying figures. FIG. 3 is a schematic perspective view of the first embodiment of the spherical mirror surface processing device of the present invention.

Workpiece 1 is a long cylindrical material such as is used in optical fiber connectors, end face 8 of which is processed by means of the present processing device into a mirror surface having a highly accurate convex spherical form. Abrasive tape 2 is a thin, belt-like abrasive tape that is fed from supply roller 11 and taken up by take-up roller 12, and that moves across stage 3 with its surface contacting and grinding end face 8 of workpiece 1. Stage 3 is a horizontal stage of substantially rectangular parallelepiped shape in which the upper side of a section taken at a right angle to the longitudinal direction describes a concave arc having a prescribed radius of curvature.

Sponge 4 is a water-holding material that is provided on the outer side of supply roller 11 and extending along the entire length of supply roller 11, that comes in contact with the surface of abrasive tape 2 that is wound around supply roller 11, and that is provided for uniformly supplying the grinding fluid contained within its sponge-like body as a thin film to the surface of abrasive tape 2. The grinding fluid supplied to sponge 4 is supplied from grinding fluid storage tank 14 by way of pipe 5 at a prescribed amount by means of nozzle 7.

Chuck 6 holds workpiece 1 perpendicular to the upper surface of stage 3, and moreover, in a state such that the axis of rotation of workpiece 1 coincides with the center of curvature of the concave arc surface of the upper surface of stage 3, and is turned by chuck rotation motor 13 by way of a toothed wheel mechanism.

Chuck rotation motor 13 rotates both chuck 6 and pinion 10 provided at the end of its shaft. Pinion 10 meshes with rack 9 that is secured parallel to the longitudinal direction of stage 3, and by putting chuck rotation motor 13 into motion, chuck rotation motor 13 together with chuck 6 can move back and forth in the longitudinal direction of stage 3.

Abrasive tape take-up motor 18 is provided coaxially with take-up roller 12 such that abrasive tape 2 is taken up by take-up roller 12.

Fixed load mechanism 19 is a mechanism for applying a prescribed vertical load to workpiece 1, which is secured in chuck 6, and placing workpiece 1 in contact with abrasive tape 2.

Explanation is next presented regarding the first processing method of the present invention for processing end face 8 of workpiece 1 into a spherical mirror surface by means of the spherical mirror surface processing device of the present invention described above. First, prescribed abrasive tape 2 is rolled onto supply roller 11, following which one end of abrasive tape 2 is pulled out, extended across the upper surface of stage 3, and affixed to take-up roller 12. The axis of rotation of workpiece 1 is next placed in alignment with the center of curvature of the concave arc surface on the upper surface of stage 3, and after placing end face 8 of workpiece 1 in contact with abrasive tape 2, a prescribed vertical load is applied by means of fixed load mechanism 19. A prescribed amount of prescribed grinding fluid is then continuously supplied to sponge 4 from grinding fluid storage tank 14 by way of nozzle 7, sponge 4 is placed into contact with abrasive tape 2 and generates a thin and uniform grinding fluid film on the surface of abrasive tape 2.

Abrasive tape take-up motor 18 is put into motion and abrasive tape 2 is wound up. Chuck rotation motor 13 is put into motion, whereby workpiece 1 is rotated and end face 8 comes into contact with the concave arc surface of stage 3 and is ground by abrasive tape 2, which forms a concave arc surface. Simultaneously, chuck rotation motor 13 also rotate's pinion 10, whereby workpiece 1 moves on rack 9 in the longitudinal direction of stage 3.

Workpiece 1 is thus rotated and moved on abrasive tape 2 on stage 3. Reversing the direction of rotation of chuck rotation motor 13 both reverses the direction of rotation of workpiece 1 and reverses the direction of movement of workpiece 1, thereby giving workpiece 1 a back-and-forth movement.

When a prescribed ground surface is formed in this way on end face 8 of workpiece 1, workpiece 1 is removed from chuck 6, another workpiece 1 that is still. unprocessed is mounted in chuck 6, and identical processing carried out. When all of abrasive tape 2 has been used, it is exchanged with prescribed abrasive tape 2 for finishing which has extremely fine grading. The finishing process is carried out by the same processing steps on workpieces 1 that have been processed in the initial process using the first abrasive tape 2, and processing is completed by finishing to a prescribed mirror surface.

Figure 4:
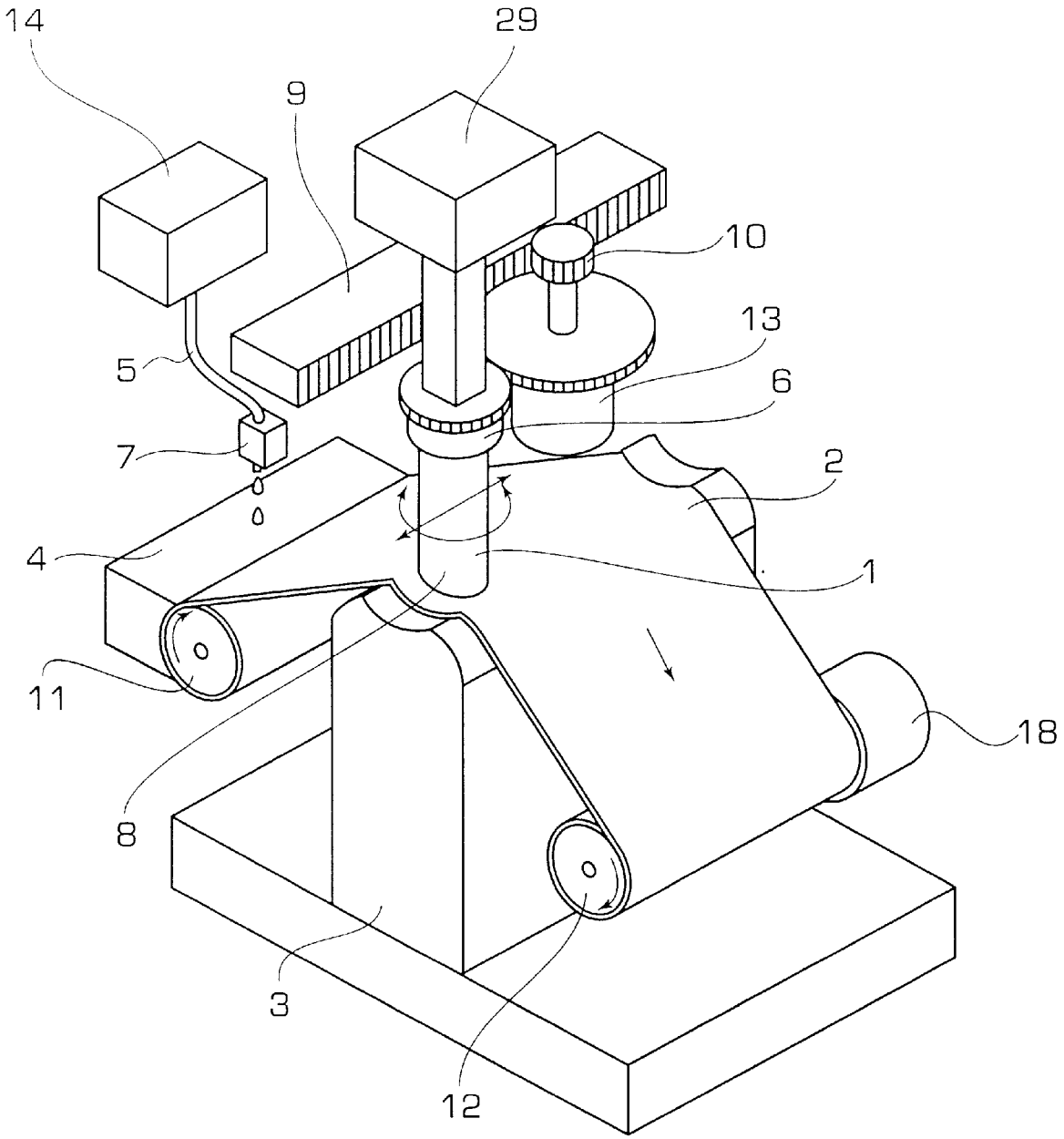
FIG. 4 is a schematic perspective view showing the second embodiment of the spherical mirror surface processing device of the present invention.

FIG. 4 is a perspective view of the second spherical mirror surface processing device of the present invention. The second spherical mirror surface processing device of the present invention shown in FIG. 4 changes fixed load mechanism 19 of the first processing device shown in FIG. 3 to load varying mechanism 29. In other words, this device has the same construction as the first processing device shown in FIG. 3 with the exception of load varying mechanism 29.

Load varying mechanism 29 varies the vertical load applied to workpiece 1 between various values, whereby the processing pressure at which end face 8 of workpiece 1 contacts abrasive tape 2 can be varied between various desired values during processing, thereby enabling a more efficient grinding operation.

Figure 5A:
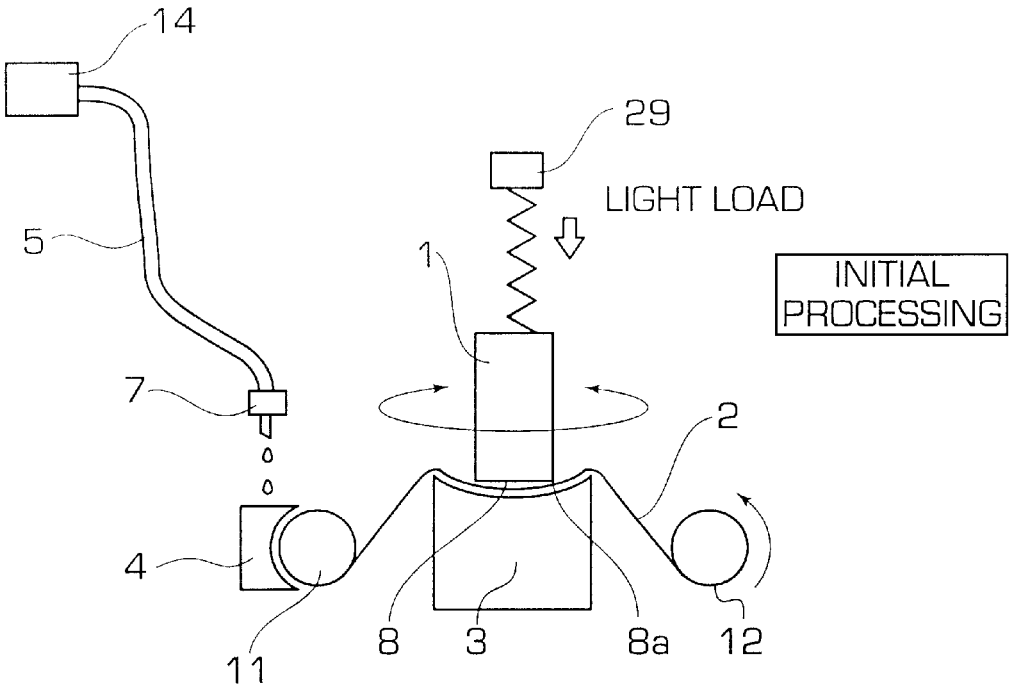
FIG. 5A illustrates the initial processing in the second spherical mirror surface processing method of the present invention.
Figure 5B:
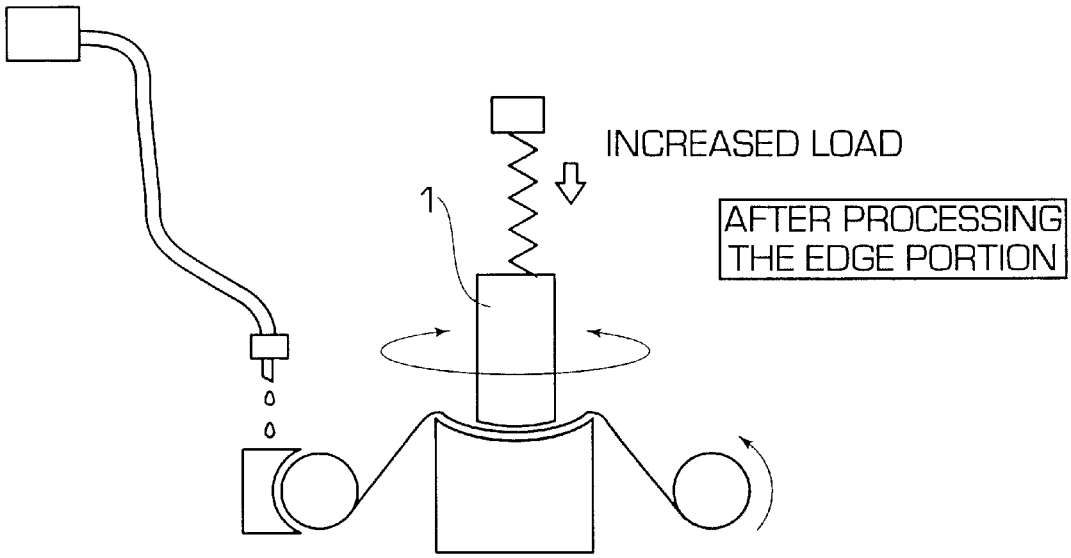
FIG. 5B illustrates the processing following edge portion processing in the second spherical mirror surface processing method of the present invention.

FIGS. 5A and 5B are views illustrating the second spherical mirror surface processing method according to the present invention using the device shown in FIG. 4, FIG. 5A showing the initial processing and FIG. 513 showing the state following the processing of the edge portion.

In the initial processing shown in FIG. 5A, a light load is applied to workpiece 1 by means of load varying mechanism 29 during the Lime interval until edge portion 8*a* of end face 8 of workpiece 1 is processed. After the passage of a fixed time interval of processing edge portion 8*a*, the load is increased by means of load varying mechanism 29 and processing is continued, as shown in FIG. 5B. Reducing the load in initial processing in this way prevents instability in the movement of the abrasive tape and enables more efficient processing.

Figure 6:
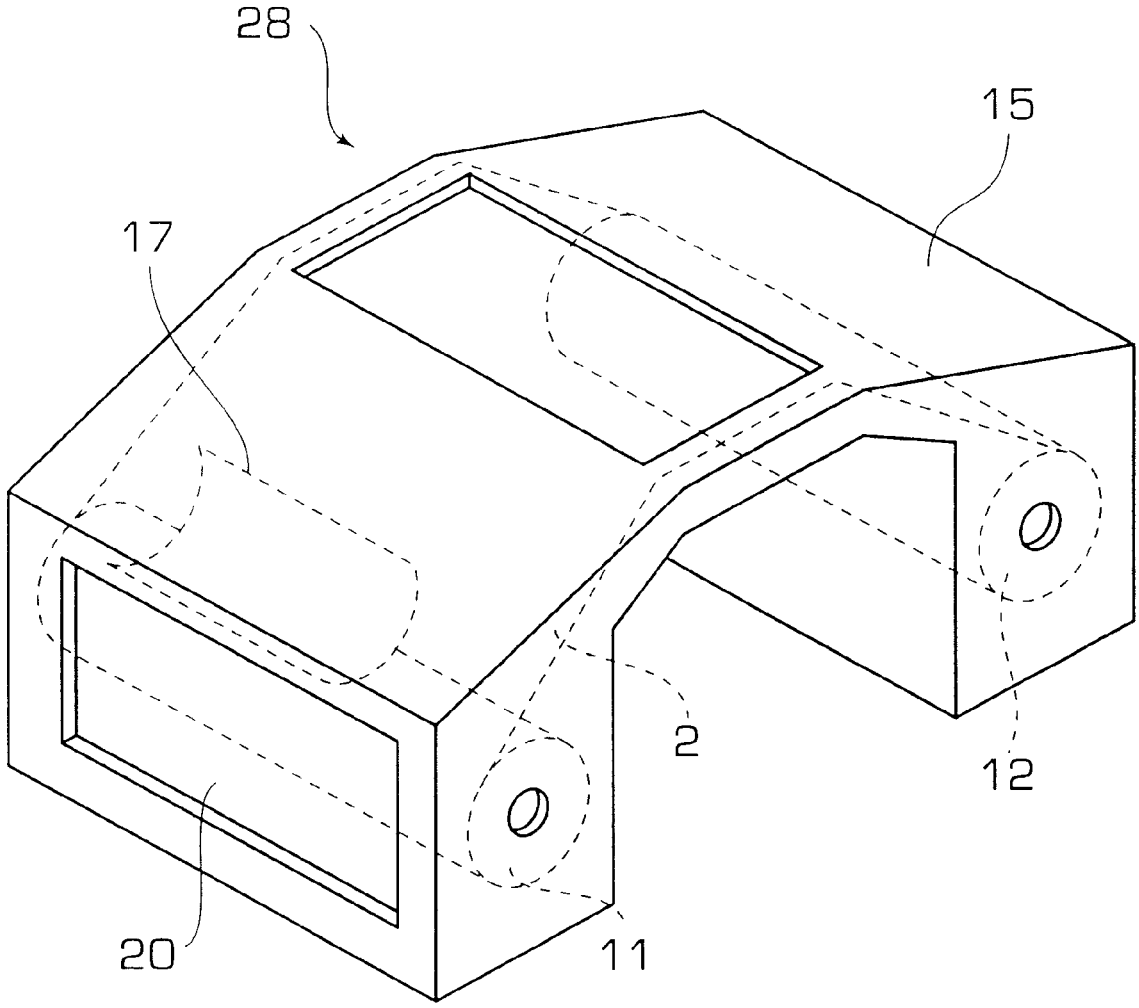
FIG. 6 is a schematic perspective view of the cassette abrasive tape device of the present invention.
Figure 7:
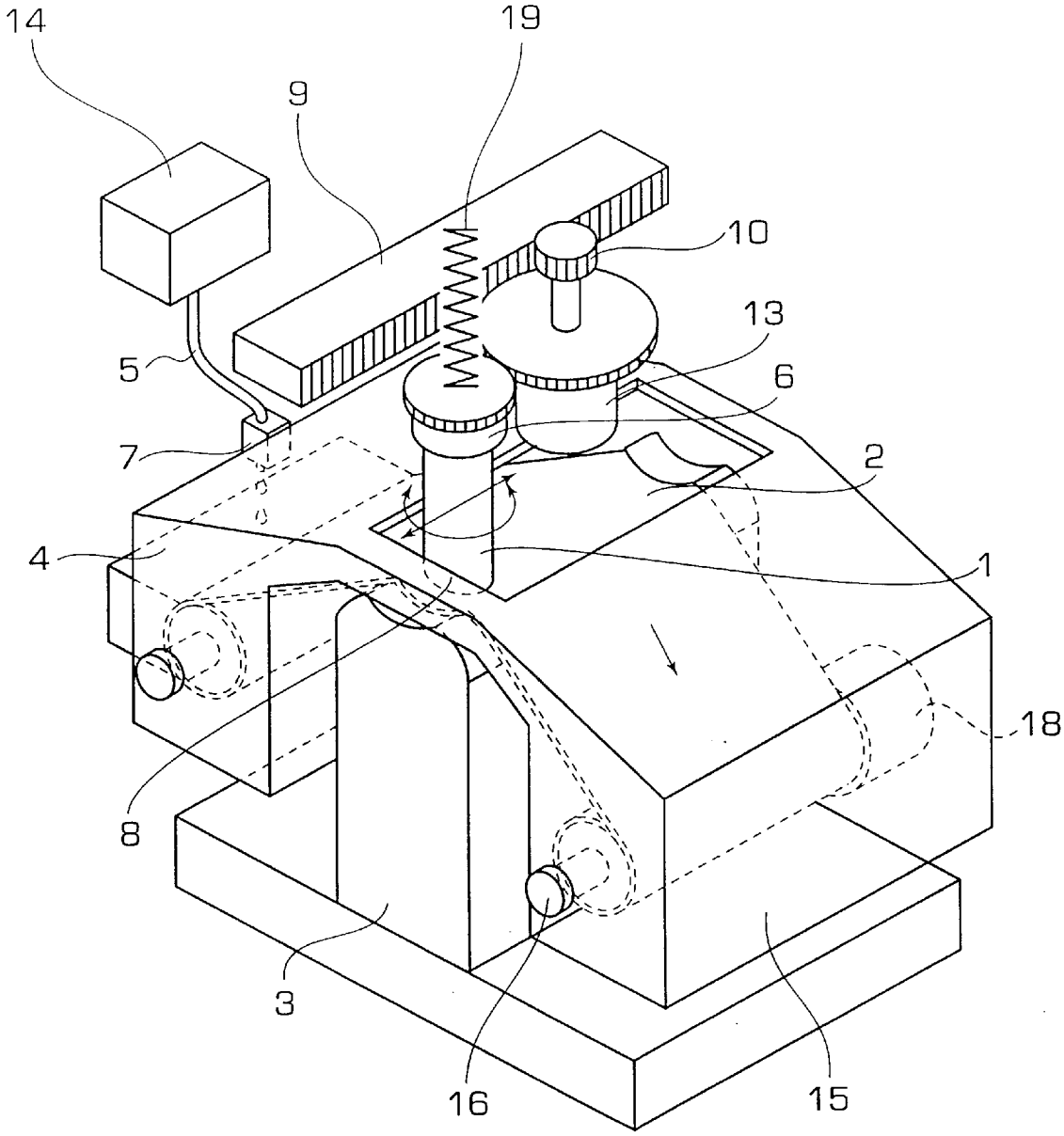
FIG. 7 is a schematic perspective view of the third spherical mirror surface processing device of the present invention.

FIGS. 6 and 7 are perspective views illustrating the third spherical mirror surface processing device that includes a cassette abrasive tape device according to the present invention. As shown in FIG. 6, cassette abrasive tape device 28 is formed from cassette 15, inside which are provided supply roller 11 on which abrasive tape 2 is wound, take-up roller 12 in which the end of abrasive tape 2 is secured, and leaf spring 17. This cassette is designed for mounting in cassette mounting mechanism 16 that employs pins that are inserted into the centers of the supply roller and take-up roller to position the cassette.

Workpiece 1 and abrasive tape 2 are placed in contact such that the axis of rotation of workpiece 1 is aligned with the center of curvature of the section of the concave arc surface on stage 3, and chuck rotation motor 13 is put into motion while abrasive tape 2 is driven at a low speed by abrasive tape take-up motor 18. At the same time, chuck 6 is moved back and forth in the longitudinal direction of rack 9 by means of rack 9 and pinion 10. Sponge 4 is arranged so as to contact the surface of abrasive tape 2 through window 20 in cassette 15, and grinding fluid is supplied to sponge 4 by nozzle 7 to generate a thin and uniform film of grinding fluid on the surface of abrasive tape 2. Workpiece 1 both rotates and moves back and forth and undergoes initial processing into a convex spherical form. When abrasive tape 2 has been wound up to its end after processing a plurality of workpieces, the cassette is exchanged with another cassette abrasive tape device 28 having another abrasive tape 2 of finer grading, and workpieces 1 that have undergone initial processing are then finished by the same process. End face 8 of workpiece 1 is gradually ground and polished to a smooth, convex spherical surface. Processing is completed when the spherical shape has attained a prescribed state. The use of the above-described cassette abrasive tape device 28 simplifies exchange of the abrasive tape.

Figure 8:
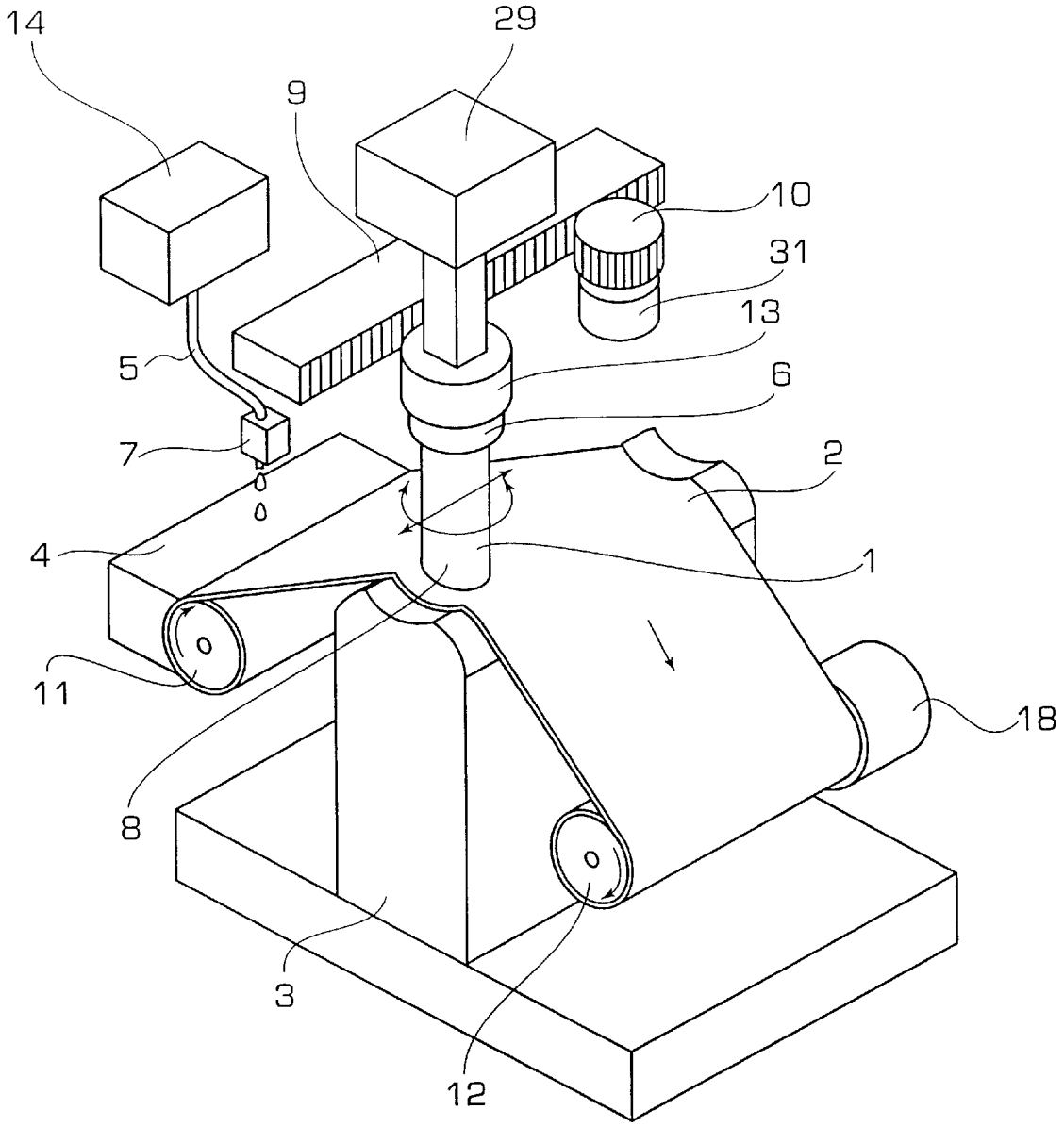
FIG. 8 is a schematic perspective view of the fourth spherical mirror surface processing device of the present invention.

FIG. 8 is a schematic perspective view of the fourth spherical mirror surface processing device of the present invention. The difference between this device and the second spherical mirror surface processing device of the present invention described in conjunction with FIG. 4 principally involves the provision of chuck reciprocation motor 31 in addition to chuck rotation motor 13. Chuck rotation motor 13 is arranged coaxially with chuck 6 and rotates only chuck 6, while newly provided chuck reciprocation motor 31 rotates pinion 10 that meshes with rack 9 and is provided to drive the back-and-forth movement of workpiece 1.

By means of the above-described construction, the fourth spherical mirror surface processing device of the present invention allows the direction of rotation of workpiece 1 to be reversed midway in the linear back-and-forth movement of workpiece 1, and therefore does not bring about states in which the processing is instantaneously halted by the simultaneous reversal of both the back-and-forth movement and the rotating movement of workpiece 1 that occurs in the first, second, and third devices described hereinabove. Accordingly, the processing efficiency of workpiece 1 can be improved, and in addition, more stable processing can be performed because abrupt loads are not applied to workpiece. As for the other points described hereinabove such as the supply of grinding fluid, the application of load to workpiece 1 by load varying mechanism 29, and the finishing process achieved by exchanging abrasive tape 2, this processing method is equivalent to the methods described for the methods for the first, second, and third devices.

Detailed description is next presented regarding the embodiments of the first and second spherical mirror surface processing methods with reference to FIG. 3 and FIG. 4. The following conditions are identical in the devices shown in FIG. 3 and FIG. 4 that are used in the two processing methods. In other words:

Stage 3: Made from Teflon material and having a 17.5 mm radius of curvature for the concave arc portion of the upper surface.

Abrasive tape 2: 25 mm wide, 150 m long, and 25 $\mu$m thick. For initial processing, the abrasive particles are $Al_2O_3$ with a particle size of 8 $\mu$m; for finishing, the abrasive particles are diamond with a particle size of 1.5 $\mu$m.

Grinding fluid: Pure water is supplied to sponge 4 at the rate of 10 cc/1.5 hours (an amount suitable for forming a grinding fluid film on the surface of the abrasive tape of approximately 50 cc/$m^2$)

Figure 1:
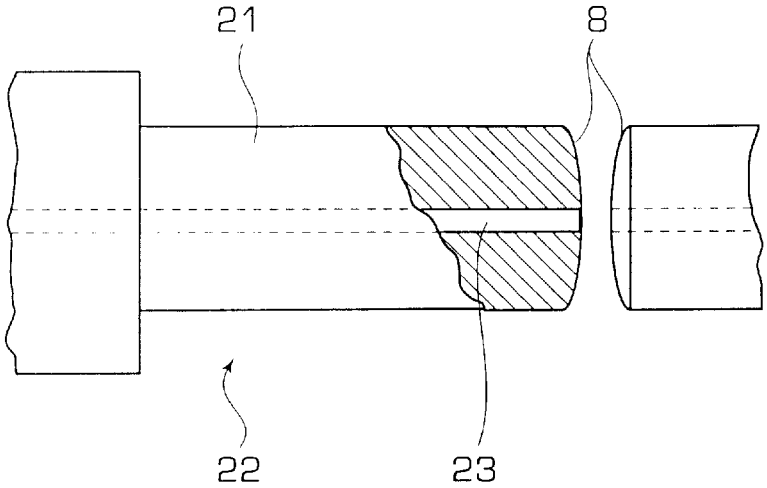
FIG. 1 is a schematic side view with one portion of an optical fiber connector cut away.
Figure 2:
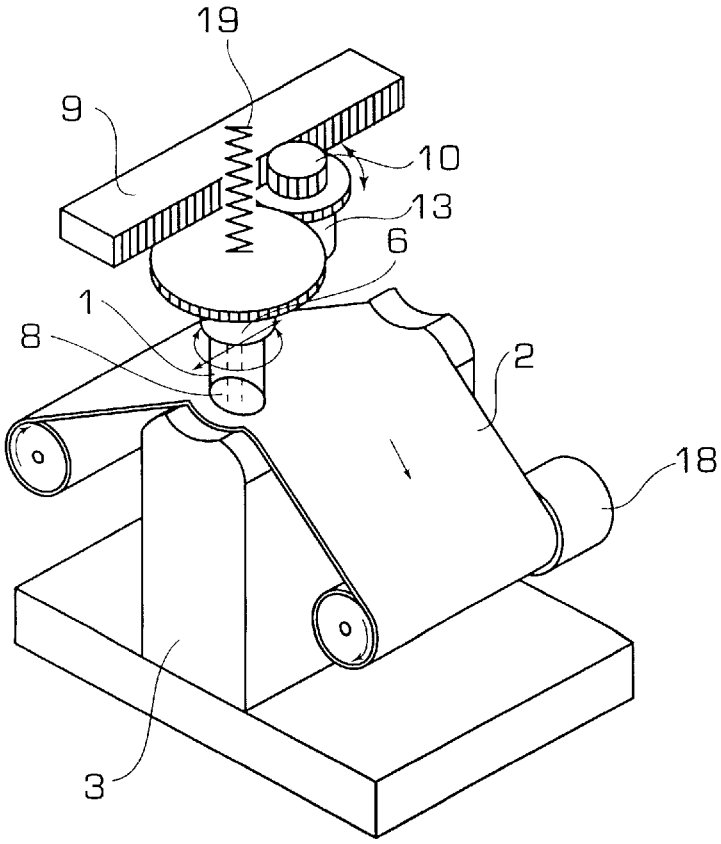
FIG. 2 PRIOR ART
FIG. 2 is a schematic perspective view showing a spherical surface processing device according to the prior art.

Workpiece 1: Optical connector 22 is constituted by glass ferrule 21,2.5 mm in diameter into which is inserted optical fiber 23,125 $\mu$m in diameter. (Refer to FIG. 1.)

Gear ratio: The gear ratio of the toothed wheels attached to chuck rotation motor 13 and chuck 6 is 2:1.

1. First spherical mirror surface processing method by means of the first spherical mirror surface processing device of the present invention:

In FIG. 3, the device was established according to the above-described conditions with workpiece 1 secured in chuck 6. A vertical load of 150 gf was applied to workplace 1 by fixed load mechanism 19, and pure water was supplied to sponge 4 from nozzle 7 at the rate of 10 cc for every 1.5 hours. This supply amount was equivalent to a film of about 50 cc for every square meter of abrasive tape surface. Chuck rotation motor 13 was rotated at 200 rpm (400 rpm for workpiece 1) to carry out processing for an interval of 1.5 minutes. The same processing method was carried out for 1000 workpieces 1. The abrasives of abrasive tape 2 used for this initial processing step was $Al_2O_3$ having a-diameter of 8 $\mu$m.

Abrasive tape 2 is next exchanged for an abrasive tape 2 having diamond abrasives with a particle size of 1.5 $\mu$m in diameter for finishing, and 1000 workpieces 1 that have undergone the above-described initial processing undergo the finishing process. The vertical load, amount of pure water supplied, and motor rpm employed in the finishing process are the same as in the initial processing, and each of the 1000 workpieces 1 undergoes polishing for 1.5 minutes.

The processing of 1000 workpieces 1 was completed by the above-described continuous processing, a number that is 1.3 times the volume of workpieces completed in the prior art. Including the time for exchanging and securing workpieces, the total amount of time required for each workpiece 1 was 3.5 minutes. The radius of curvature of the spherical surface of finished end face 8 of workpiece 1 was 17.5±1 mm, the surface roughness was 0.01 $\mu$m Rmax or less, and a smooth, convex spherical mirror surface free of distortion was obtained. In addition, the optical connection loss of the optical connector 22 was 0.2 dB or less, and the return loss was 45 dB or more.

2. Second spherical mirror surface processing method by means of the second spherical mirror surface processing device of the present invention:

FIG. 4 is a perspective view of the device used in the second spherical mirror surface processing method of the present invention, and FIGS. 5A and 5B illustrate the processing method, FIG. 5A showing the initial processing and FIG. 5B showing processing following the processing of the edge portion of the end face.

The device shown in FIG. 4 is equivalent in structure in all respects to the device shown in FIG. 3 with the exception of the modification of fixed load mechanism 19 to load varying mechanism 29. An electromagnet is employed in load varying mechanism 29.

A vertical load of 100 gf is first applied to workpiece 1 by load varying mechanism 29, following which chuck rotation motor 13 is rotated at 200 rpm (400 rpm for workpiece 1) to carry out processing for an interval of 10 seconds to process pointed edge portion 8*a* of flat end face 8 of workpiece 1 (Refer to FIG. 5A). The load is then increased to 150 gf by means of load varying mechanism 29 and processing is carried out for 80 seconds to complete initial processing lasting a total of 90 seconds (Refer to FIG. 5B).

After carrying out initial processing for 1000 workpieces 1 in this way, abrasive tape 2 is exchanged for a tape for finishing, and the above-described 1000 workpieces 1 that have undergone initial processing then undergo the finishing process. During the finishing process, the vertical load is 150 gf, the chuck rotation motor 13 is rotated at 200 rpm (400 rpm for the workpieces 1), and the finishing process is of 90 seconds' duration. The amount of pure water supplied to sponge 4 in the initial and finishing processes is 10 cc per 1.5 hours (approximately 50 cc/$M^2$).

The above-described process completed the continuous processing of 1000 workpieces 1, and this number was 1.3 times the processing volume of workpieces completed in the prior art. Including the time for exchanging, the total amount of time required for each workpiece 1 was 3.5 minutes. The radius of curvature of the spherical surface of finished end face 8 of workpiece 1 was 17.5±1 mm, the surface roughness was 0.008 $\mu$m Rmax or less, and a smooth, convex spherical mirror surface free of distortion was obtained.

3. Third embodiment by means of the third spherical mirror surface processing device of the present invention:

Description of the third embodiment of spherical mirror surface processing device of the present invention is next presented with reference to FIG. 6 and FIG. 7. This embodiment employs cassette abrasive tape device 28 shown in FIG. 6.

The winding length of the tape used in this cassette abrasive tape device 28 is 150 m, its width is 25 mm, and the material thickness is 25 $\mu$m. Abrasive particles of $Al_2O_3$ measuring 8 $\mu$m in diameter are applied to the tape used in initial processing, and diamond abrasive particles measuring 1.5 $\mu$m in diameter are applied to the tape used for finishing.

The device shown in FIG. 7 is the device shown in FIG. 3 with cassette abrasive tape device 28 of FIG. 6 installed. Using this device, 1000 workpieces 1 can be processed under the same conditions as the first processing method of the present invention shown in FIG. 3, and a processing volume that is 1.3 times that of the prior art can be obtained. In addition, the time for exchanging abrasive tapes can be reduced by ½. The time for processing was 3.5 minutes for each workpiece. The radius of curvature of the finished spherical surface of end face 8 of workpiece 1 was 17.5±1 mm, the surface roughness was 0.01 μmRmax or less, and a smooth convex spherical mirror surface free of distortion was obtained. In addition, the optical connection loss of the optical connector 22 was 0.2 dB or less, and the return loss was 47 dB or more.

4. Embodiment by means of the fourth spherical mirror surface processing device of the present invention: Description of the fourth spherical mirror surface processing device of the present invention is next presented with reference to FIG. 8.

After setting workpiece 1, a load in the vertical direction of 100 gf was applied to workpiece 1 by means of load varying mechanism 29, and pure water was supplied to sponge 4 by means of nozzle 7 at the rate of 10 cc per 1.5 hours, a rate which corresponds to a coverage of about 50 $cc/m^2$. Chuck rotation motor 13 is turned at 400 rpm (400 rpm for the workpiece), chuck reciprocation motor 31 is turned to give chuck 6 a reciprocating movement, and processing is performed for 10 seconds. The load is then increased to 150 gf by load varying mechanism 29 and processing is performed for 80 seconds. After processing 1000 workpieces 1, abrasive tape 2 is exchanged, a vertical load of 150 gf is applied by load varying mechanism 29 to workpieces 1 that have previously undergone the initial processing, pure water is applied to sponge 4 by nozzle 7 at the rate of 10 cc every 1.5 hours, chuck rotation motor 13 is turned at 400 rpm, chuck reciprocation motor 31 is turned, and finishing processing is carried out for 90 seconds. Abrasive tape 2 used for finishing is a tape to which diamond abrasive particles measuring 1.5 μm in diameter have been bonded, and has a winding length of 150 m, a width of 25 mm, and a material thickness of 25 μm.

In this embodiment, 1000 workpieces 1 can be processed continuously, and a processing volume 1.3 times that of the prior art was obtained. The time required to process the spherical surface of workpiece 1, including the time necessary for changing workpieces 1, was 3.5 minutes per workpiece. The radius of curvature of the finished spherical surface of end face 8 of workpiece 1 was 17.5±1 mm, the surface roughness was 0.005 μmRmax or less, and a smooth convex spherical mirror surface free of distortion was obtained.

In the above-described embodiments, workpiece 1 was a cylindrical glass ferrule having an inserted silica optical fiber, but an excellent convex spherical mirror surface may similarly be obtained if workpiece 1 has a zirconia ceramic ferrule or a plastic ferrule, or if columnar or block shape is processed instead of a ferrule.

In the above-described embodiments, $Al_2O_3$ was used as the abrasive particles for initial processing and diamond was used as the abrasive micro-particles for finishing, but a similar effect can be obtained if SiC.diamond is used as the abrasive particles for initial processing and $CeO_2.Cr_2O_3$ is used as the abrasive particles for finishing.

In addition, although positioning pins were used in cassette mounting mechanism 16, the structure of the mechanism may take any form that allows positioning of the cassette.

Finally, although a electromagnet was used as load varying mechanism 29, the same effect can be obtained by using a spring and a pressure cylinder or motor in load varying mechanism 29.

The entire disclosure of Japanese Patent Laid-open No. 29599/97 dated Feb. 4, 1997 including specification, claims, drawings and summary are incorporated herein by reference in its entirety.

It is to be understood, however, that although the characteristics and advantages of the present invention have been set forth in the foregoing description, the disclosure is illustrative only, and changes may be made in the arrangement of the parts within the scope of the appended claims.

What is claimed is:

1. A spherical mirror surface processing method comprising the steps of arranging an abrasive tape over a stage, a section of which taken at a right angle to a longitudinal direction of which describes a concave arc; driving said abrasive tape; supplying grinding fluid to the surface of said abrasive tape to produce a thin and uniform film of grinding fluid transversely across said abrasive tape and along its longitudinal direction; applying pressure to bring an end face of a workpiece into contact with said abrasive tape; giving a rotating movement and a reciprocating movement to said workpiece; and processing said end face of said workpiece by the grinding action of said abrasive tape.

2. A spherical mirror surface processing method according to claim 1, wherein said pressure applied to said end face of said workpiece is reduced in an initial processing in which edge portions of said end face of said workpiece are processed, and the processing pressure is increased upon completion of the processing of said edge portions.

3. A spherical mirror surface processing device according to claim 1, wherein said grinding fluid is an amount between 10 $cc/m^2$ and 50 $cc/m^2$.

4. A spherical mirror surface processing device comprising:

a stage, a section of which taken at a right angle to a longitudinal direction of which describes a concave arc;

an abrasive tape arranged on said stage at said right angle to said longitudinal direction;

a mechanism for driving said abrasive tape;

a mechanism for applying pressure to bring an end face of a workpiece into contact with said abrasive tape wherein a center of rotation of a rod-like said workpiece coincides with a center of a radius of curvature of said section of said stage;

a mechanism for giving a reciprocating movement to said rod-like workpiece in said longitudinal direction of said concave arc in said stage while giving a rotating movement to said rod-like workpiece; and a grinding fluid storage tank that contains grinding fluid for producing a thin and uniform film of grinding fluid on the surface of said abrasive tape transversely across said abrasive tape and along its longitudinal direction.

5. A spherical minor surface processing device according to claim 4, wherein said abrasive tape is accommodated in a cassette abrasive tape device: comprising: an abrasive tape supply roller; an abrasive tape take-up roller; a leaf spring that applies resistance to rotation of said supply roller; and a cassette that accommodates said supply roller and said take-up roller, wherein said cassette abrasive tape device comprises an opening for supplying said grinding fluid to said abrasive tape by means of said grinding fluid storage tank; said cassette abrasive tape device allows insertion into or ejection from a mechanism for driving said abrasive tape.

6. A spherical mirror surface processing device according to claim 5, further comprising a load varying device that can at least one of increase and decrease processing pressure applied to said end face of said workpiece.

7. A spherical mirror surface processing device according to claim 6, further comprising a load varying device that reduces said processing pressure applied to said end face of said work-piece during initial processing in which edge portions of said end face of said workpiece are processed, and increases said processing pressure upon completion of the processing of said edge portions.

8. A spherical mirror surface processing device according to claim 4, further comprising a load varying device that can at least one of increase and decrease processing pressure applied to said end face of said workpiece.

9. A spherical mirror surface processing device according to claim 5, further comprising a load varying device that reduces said processing pressure applied to said end face of said workpiece during initial processing in which edge portions of said end of said workpiece are processed, and increases said processing pressure upon completion of the processing of said edge portions.

10. A spherical mirror surface processing device according to claim 4, further comprising a device that reverses the direction of rotation of said workpiece midway in a linear movement of said reciprocating movement.

11. A spherical mirror surface processing device comprising:

a stage, a section of which taken at a right angle to a longitudinal direction of which describes a concave arc;

an abrasive tape arranged on said stage at said right angle to said longitudinal direction;

a mechanism for driving said abrasive tape;

a mechanism for applying pressure to bring an end face of a workpiece into contact with said abrasive tape wherein a center of rotation of a rod-like said workpiece coincides with a center of a radius of curvature of said section of said stage;

a mechanism for giving a reciprocating movement to said rod-like workpiece in said longitudinal direction of said concave arc in said stage while giving a rotating movement to said rod-like workpiece; and a grinding fluid storage tank that contains grinding fluid for producing a thin and uniform film of grinding fluid on the surface of said abrasive tape transversely across said abrasive tape and along its longitudinal direction, wherein said abrasive tape is accommodated in a cassette abrasive tape device comprising:

an abrasive tape supply roller;

an abrasive tape take-up roller;

a leaf spring that applies resistance to rotation of said supply roller; and a cassette that accommodates said supply roller and take-up roller, and wherein said cassette abrasive tape device comprises an opening for supplying said grinding fluid to said abrasive tape by means of said grinding fluid storage tank, and allows insertion into or ejection from a mechanism for driving said abrasive tape.

* * * * *